US010170853B2

(12) United States Patent
Houvenaghel et al.

(10) Patent No.: US 10,170,853 B2
(45) Date of Patent: Jan. 1, 2019

(54) ELECTRICAL CONNECTOR ALLOWING DISASSEMBLY, ELECTRONIC MODULE, AND ASSEMBLY METHOD

(71) Applicants: Connecteurs Electriques Deutsch, Evreux (FR); TE Connectivity Corporation, Berwyn, PA (US)

(72) Inventors: Fabien Houvenaghel, Evreux (FR); Benjamin Michael Grab, Annville, PA (US); Frederic Duval, Aviron (FR); Thierry Corriou, Ecquevilly (FR)

(73) Assignees: Connecteurs Electriques Deutsch, Evreux (FR); TE Connectivity Corporation, Berwyn, PA (US)

( * ) Notice: Subject to any disclaimer, the term of this patent is extended or adjusted under 35 U.S.C. 154(b) by 0 days.

(21) Appl. No.: 15/669,255

(22) Filed: Aug. 4, 2017

(65) Prior Publication Data

US 2017/0338583 A1 Nov. 23, 2017

Related U.S. Application Data

(63) Continuation of application No. PCT/EP2016/052540, filed on Feb. 5, 2016.

(30) Foreign Application Priority Data

Feb. 6, 2015 (EP) ..... 15305177

(51) Int. Cl.
*H01R 12/00* (2006.01)
*H01R 13/516* (2006.01)
(Continued)

(52) U.S. Cl.
CPC ..... *H01R 13/516* (2013.01); *H01R 12/724* (2013.01); *H01R 12/727* (2013.01); *H01R 13/514* (2013.01); *H01R 13/518* (2013.01)

(58) Field of Classification Search
CPC . H01R 12/716; H01R 12/714; H01R 13/5213
(Continued)

(56) References Cited

U.S. PATENT DOCUMENTS 5,920,459 A * 7/1999 Weber ..... H01R 13/6215 361/752
7,722,402 B2 5/2010 Pepe et al.
(Continued)

FOREIGN PATENT DOCUMENTS

CN 101529665 A 9/2009
CN 103682702 A 3/2014
(Continued)

OTHER PUBLICATIONS

European Patent Office Official Communication, dated Jun. 7, 2017, 7 pages.
(Continued)

*Primary Examiner* — Phuong Dinh
(74) *Attorney, Agent, or Firm* — Barley Snyder

(57) ABSTRACT

An electrical connector comprises a casing and a connector module. The casing has a retaining member. The connector module has an electrically insulating contact carrier and a plurality of electrically conductive contacts. The connector module is at least partially surrounded by the casing and is retained at the casing by the retaining member. The retaining member exerts a retaining force on the connector module in a direction along a mating direction of the electrical connector. The connector module is removable from the retaining member in a direction transverse to the mating direction.

17 Claims, 11 Drawing Sheets

(51) Int. Cl.
*H01R 12/72* (2011.01)
*H01R 13/514* (2006.01)
*H01R 13/518* (2006.01)

(58) Field of Classification Search
USPC ..... 439/76.1
See application file for complete search history.

(56) References Cited

U.S. PATENT DOCUMENTS

| | | | |
|---|---|---|---|
| 8,734,169 | B2 | 5/2014 | Werner et al. |
| 9,277,658 | B2 | 3/2016 | Tanaka et al. |
| 2002/0072276 | A1 | 6/2002 | Lewis |

FOREIGN PATENT DOCUMENTS

| | | | |
|---|---|---|---|
| JP | 5575314 | B1 | 8/2014 |
| WO | 2008091253 | A1 | 7/2008 |
| WO | 2011160971 | A1 | 12/2011 |

OTHER PUBLICATIONS

Chinese First Office Action and English translation, dated Aug. 3, 2018, 43 pages.

* cited by examiner

ELECTRICAL CONNECTOR ALLOWING DISASSEMBLY, ELECTRONIC MODULE, AND ASSEMBLY METHOD

CROSS-REFERENCE TO RELATED APPLICATIONS

This application is a continuation of PCT International Application No. PCT/EP2016/052540, filed on Feb. 5, 2016, which claims priority under 35 U.S.C. § 119(a)-(d) to European Patent Application No. 15305177.6, filed on Feb. 6, 2015.

FIELD OF THE INVENTION

The present invention relates to an electrical connector and, more particularly, to an electrical connector having a casing and at least one connector module.

BACKGROUND

Electrical connectors are critical to the performance of electronic devices and components in all fields of application. Specifically for aerospace, defense, and marine applications, electrical connectors often are high-quality precision components; if only a part of the connector is defective or outdated, it is cost-prohibitive to discard or replace the entire connector. Known modular electrical connectors thus have a casing and a connector module inserted therein. This arrangement permits maintenance or repair by exchanging the defective or no longer desired connector module for another one that is functioning properly or of another type. However, in known modular electrical connectors, disassembly is either cumbersome or impossible.

A known electronic module, for example for an in-flight entertainment system in an aeronautical application, is shown in FIGS. 7-11. The electronic module comprises a circuit carrier 201 with a substrate 202, for example a printed circuit board (PCB), that carries a plurality of connector modules 204 which are connected to different electrically conductive leads. One or more integrated circuits and/or other passive or active electronic components (not shown) are mounted on the substrate 202. The connector modules 204 are angular connector modules similar to those shown and described in international patent application WO 2011/160971.

The circuit carrier 201, as shown in FIGS. 7-10, is assembled in a two-part casing having a retainer shell 206 and a separate cover shell 208. As shown in FIG. 7, the circuit carrier 201 is mounted in the retainer shell 206 by sliding it into guiding grooves 210 in an inserting direction 212 which is essentially parallel to a mating direction of the connector module 204. The retainer shell 206 has a receiving passage 214 for each connector module 204. In a fully assembled state, the receiving passage 214 encompasses the connector module 204 and is formed to guide a mating connector into connection with the electronic module. Each of the connector modules 204 has a latch 216 for fixing the connector module 204 inside the receiving passage 214. The connector module 204 is thereby secured inside the casing against any movements in a direction opposite to the insertion direction 212.

The circuit carrier 201 is shown in its final mounted position firmly mounted in the retainer shell 206 in FIG. 8. The connector modules 204 are each locked within a corresponding receiving passage 214 and the substrate 202 is stabilized in the guiding grooves 210 on each side wall 218 of the retainer shell 206. In this locked position, the connector modules 204 can no longer be removed from the retainer shell 206 with destroying the electronic module 200. FIG. 9 shows how the latching means 216 interact with recesses of the receiving passages 214 for irreversibly locking the connector module 204. Moreover, it can be seen that by mounting the circuit carrier 201 carrying the connector module 204 within the receiving passages 214, undesired mechanical forces are exerted on the electrical contacts in a region where they are held within the substrate 202. These forces may cause deformation of the contacts.

In a next assembly step shown in FIG. 10, the casing of the electronic module 200 is closed by mounting a cover shell 208. The cover shell 208 is moved in the direction 212 until it has reached its final position. In the finally mounted position, the cover shell 208 is secured at the retainer shell 206 by locking protrusions 220, shown in FIG. 8, which engage with respective openings at the cover shell 208, and by a resilient snap hook 222. The snap hook 222 engages with a corresponding recess 224 provided at the cover shell 208.

The known electronic module 200 is shown in a final assembled state in FIG. 11. For maintenance or repair purposes, the cover shell 208 can be removed by actuating the snap hook 222 and subsequently removing the cover shell 208 in a direction opposite to the inserting direction 212. However, only repairs that can be performed at the inserted printed circuit board 202 are possible. The connector modules 204 can no longer be removed from the receiving passages 214.

Further, in international patent application WO 2011/160971, it is known to provide at the receiving passage 214 latching recesses that are accessible from the outside of each receiving passage 214 in order to allow for the latch 216 to be actuated. However, as each connector module 204 has its own latch 216, actuating the latch 216 of each connector module 204 at the same time and simultaneously pulling back the circuit carrier 201 is difficult and requires specific tools.

SUMMARY

An electrical connector according to the invention comprises a casing and a connector module. The casing has a retaining member. The connector module has an electrically insulating contact carrier and a plurality of electrically conductive contacts. The connector module is at least partially surrounded by the casing and is retained at the casing by the retaining member. The retaining member exerts a retaining force on the connector module in a direction along a mating direction of the electrical connector. The connector module is removable from the retaining member in a direction transverse to the mating direction.

BRIEF DESCRIPTION OF THE DRAWINGS

The invention will now be described by way of example with reference to the accompanying figures, of which.

DETAILED DESCRIPTION OF THE EMBODIMENT(S)

Figure 1:
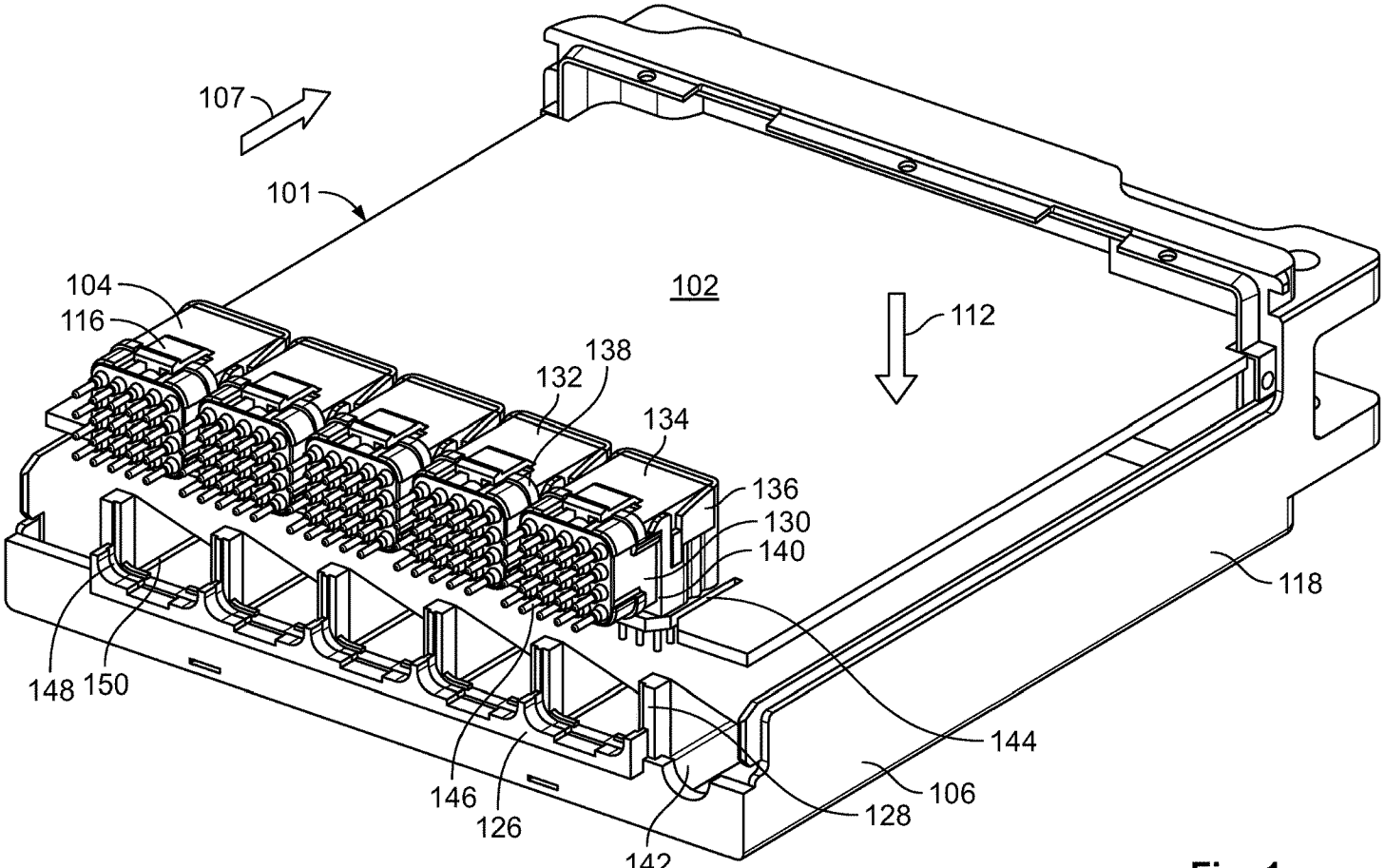
FIG. 1 is a perspective view of a circuit carrier during assembly into a retainer shell according to the invention.

Exemplary embodiments of the present invention will be described hereinafter in detail with reference to the attached drawings, wherein like reference numerals refer to like elements. The present invention may, however, be embodied in many different forms and should not be construed as being limited to the embodiments set forth herein; rather, these embodiments are provided so that the present disclosure will be thorough and complete, and will fully convey the concept of the disclosure to those skilled in the art.

A circuit carrier 101 according to the invention is shown in FIG. 1. The circuit carrier 101 comprises a substrate 102, such as a printed circuit board (PCB), which has a pattern of electrically conductive leads (not shown). A plurality of connector modules 104 is mounted on the substrate 102 and connected to the electric currently conductive lead pattern. The substrate 102 has one or more integrated circuits and/or other passive or active electronic components (not shown).

Figure 2:
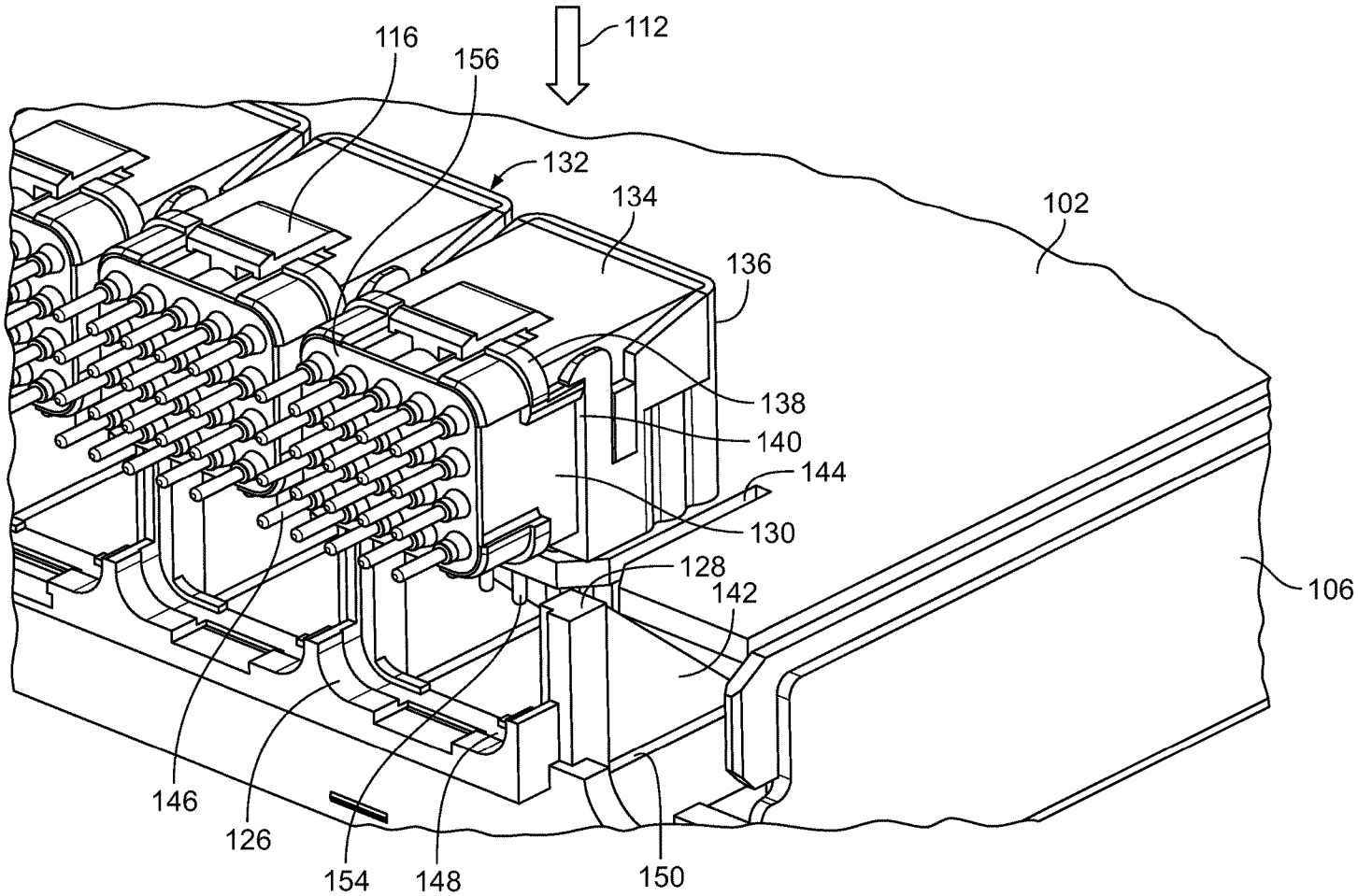
FIG. 2 is a detail perspective view of the circuit carrier and retainer shell.

The connector modules 104, as shown in FIG. 1, have an electrically insulating contact carrier 132 that is formed by a first housing 134 and a second housing 136. A retaining recess 130 is formed between a stop collar 138 disposed at the first housing 134 and an outer edge 140 of the second housing 136. The stop collar 138, as shown in FIGS. 1 and 2, extends at least in sections around the contact carrier 132. In other embodiments, the retaining recess 130 can be formed as a molded indentation in a monolithically formed housing. The connector modules 104 have a mating direction 107.

The circuit carrier 101 is shown during assembly in a retainer shell 106 in FIG. 1. The retainer shell 106 and a cover shell 108 form part of a casing 105, shown in FIG. 5, which surrounds and protects the circuit carrier 101 and allows its mounting in a larger unit. In an embodiment, polyether imide (PEI) or a PEI composite material is used for fabricating the contact carrier 132 and the retainer shell 106 and cover shell 108 of the casing 105. Composite materials include, for example, carbon fiber/PEI composites.

The circuit carrier 101 is mounted within the retainer shell 106 in a mounting direction 112 which extends perpendicular to the mating direction 107. The retainer shell 106, as shown in FIG. 1, comprises retaining members 126 for interacting with the connector modules 104 in order to exert retaining forces in a direction along the mating direction 107 of the electrical connector. Each retaining member 126 is formed by two retaining projections 128, so that an essentially U-shaped cross-section is formed; the retaining projections 128 forming the legs of the U. The retaining projections 128 engage with the corresponding retaining recesses 130 provided at both sidewalls of each connector module 104; the retaining recesses 130 are formed as guiding grooves receiving the retaining projections 128.

Each of the retaining projections 128, as shown in FIG. 1, is formed as part of a partition wall 142 of the retainer shell 106. These partition walls 142, which fit into slots 144 provided at the substrate 102, separate and electrically insulate contacts 146 of one connector module 104 from the contacts 146 of an adjacent connector module 104. The partition walls 142 also provide additional mechanical stability to the retaining projections 128. In addition to the retaining projections 128, each retaining member 126 further comprises a retaining groove 148. These retaining grooves 148 receive the stop collars 138 of the connector modules 104. Thereby, an additional safeguard against a movement in the mating direction 107 can be provided in a fully assembled state. Each of the partition walls 142 has support steps 150 supporting the substrate 102 in the assembled state.

According to the present invention, inserting the circuit carrier 101 into the retainer shell 106 does not involve any latching, locking, or irreversible connecting steps, so that the circuit carrier 101 can easily be removed in a direction opposite to the mounting direction 112 when necessary. As shown in FIGS. 1 and 2, each of the connector modules 104 may have a latch 116 as in the prior art, however, the latch 116 is not used in the present invention.

Figure 3:
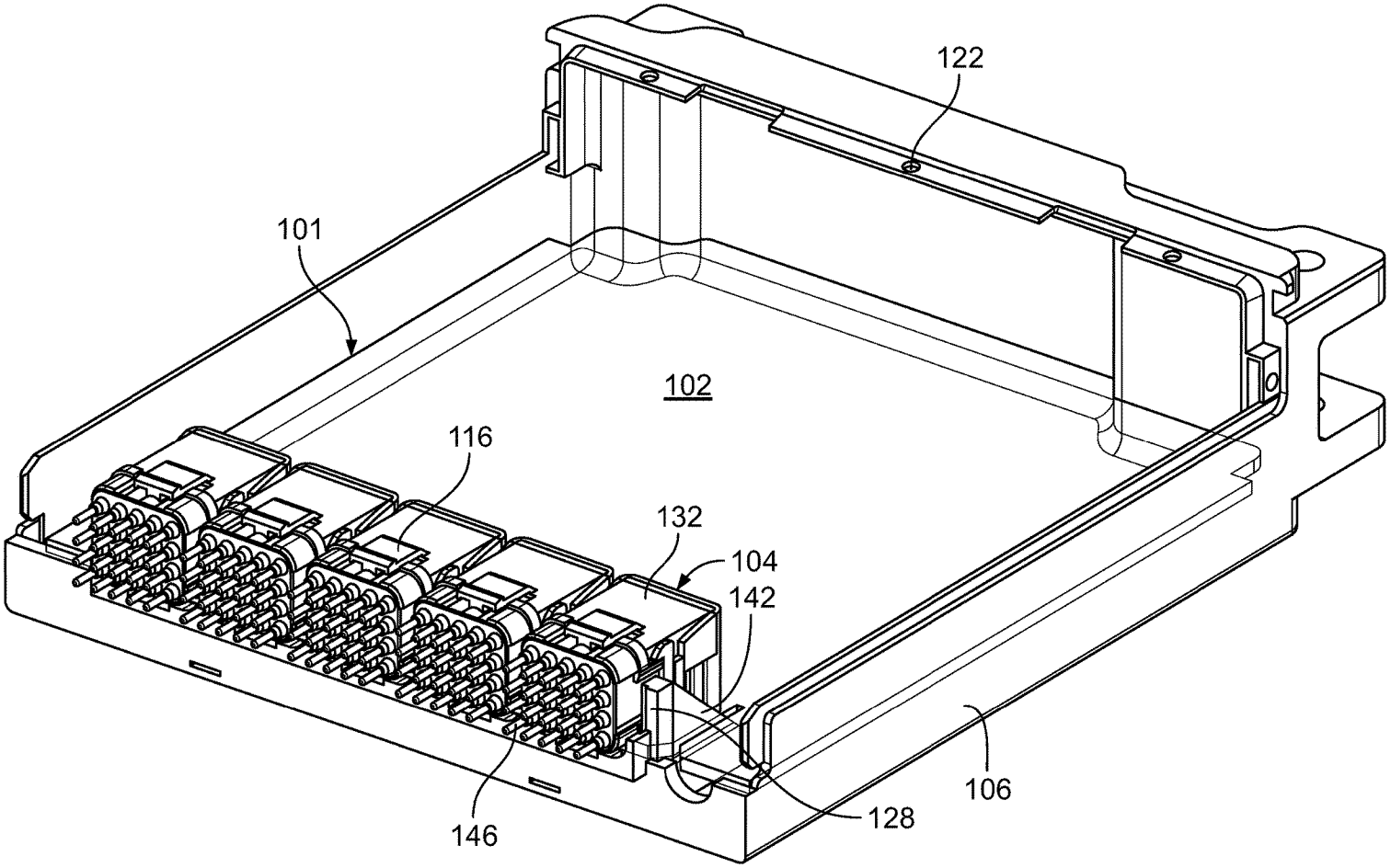
FIG. 3 is a perspective view of the circuit carrier in a final mounted position in the retainer shell.
Figure 4:
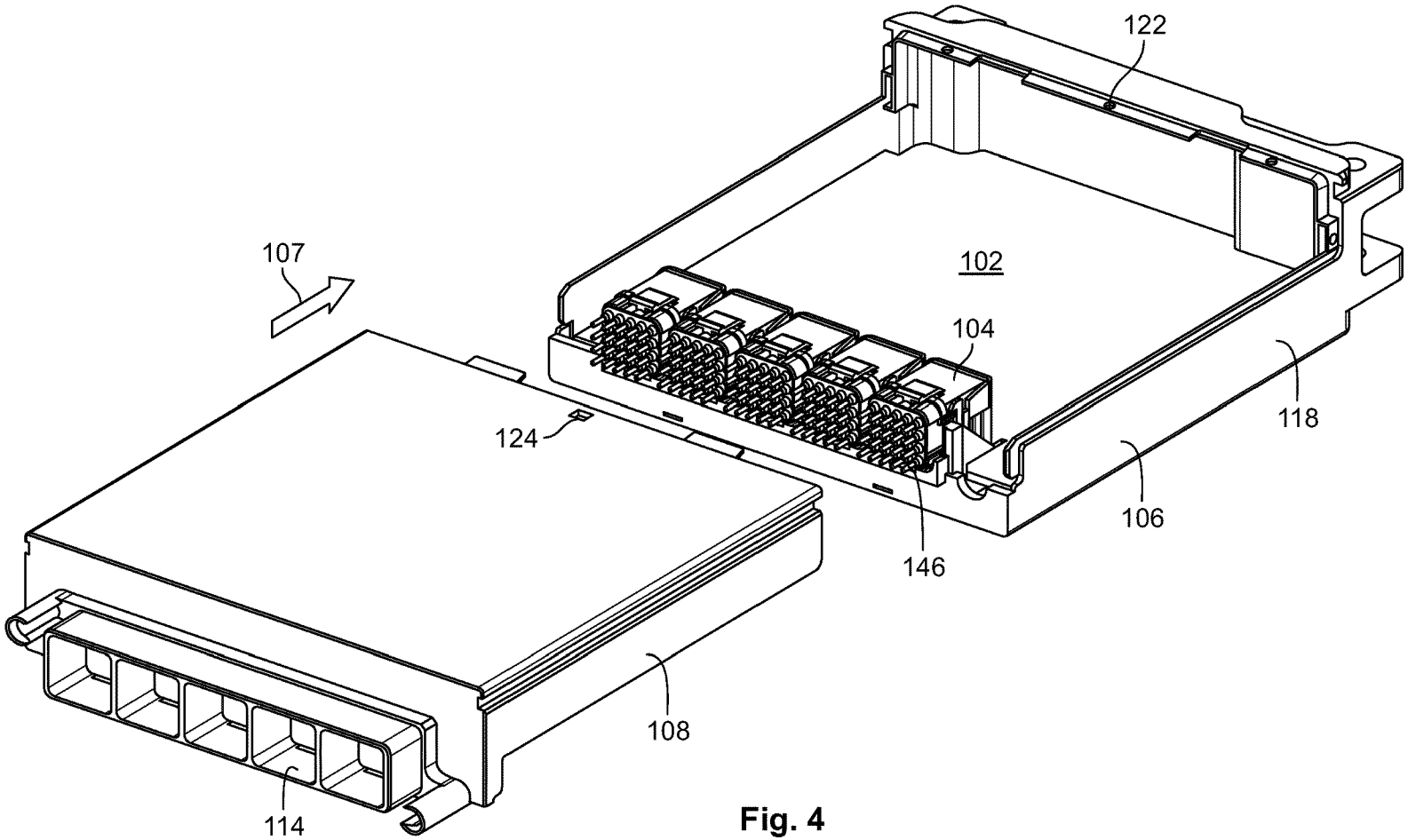
FIG. 4 is a perspective view of a cover shell and the retainer shell with the circuit carrier during assembly of the cover shell.

The circuit carrier 101 is shown in a final mounted position within the retainer shell 106 in FIG. 3. In order to close the casing 105, the separate cover shell 108 is mounted on the retainer shell 106 as shown in FIG. 4. The cover shell 108 has a plurality of receiving passageways 114 corresponding to the connector modules 104. The cover shell 108 is slid onto the retainer shell 106 in a direction along the mating direction 107. The cover shell 108 is mounted from the mating faces of the connector modules 104 towards the rear side, whereas the mounting direction 212 for the conventional cover shell 208 extends opposite to the mating direction 107. For locking the cover shell 108 at the retainer shell 106, the retainer shell 106 has a shell projection 122 which engages with recess 124 arranged at the cover shell 108. This shell projection 122 has a weaker locking force than the snap hook 222 shown in FIGS. 8-11, so that the cover shell 108 can be removed from the retainer shell 106 more easily than the cover shell 208 from the retainer shell 206.

Figure 5:
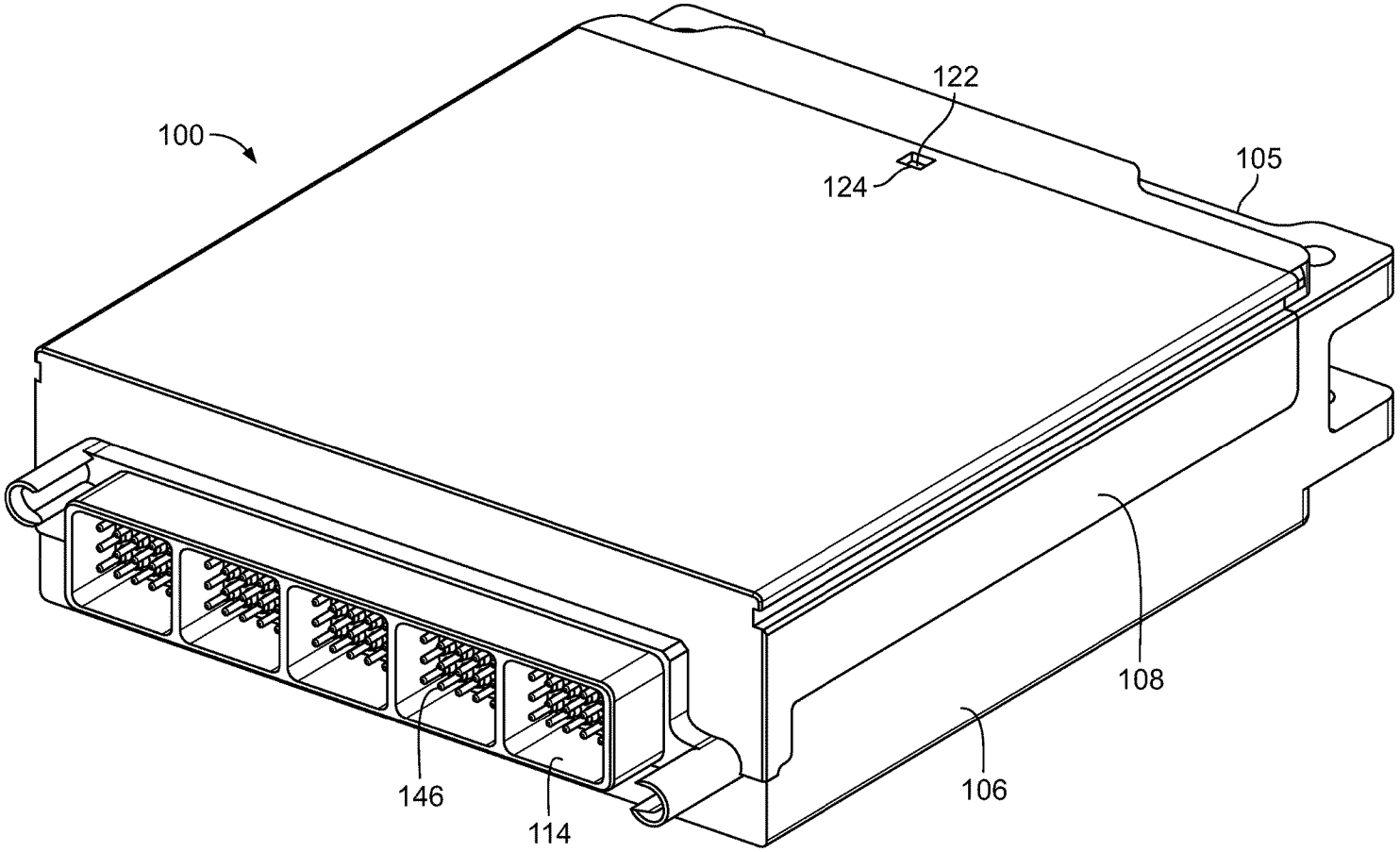
FIG. 5 is a perspective view of an electronic module including the circuit carrier, the retainer shell, and the cover shell in a final assembled state.
Figure 6:
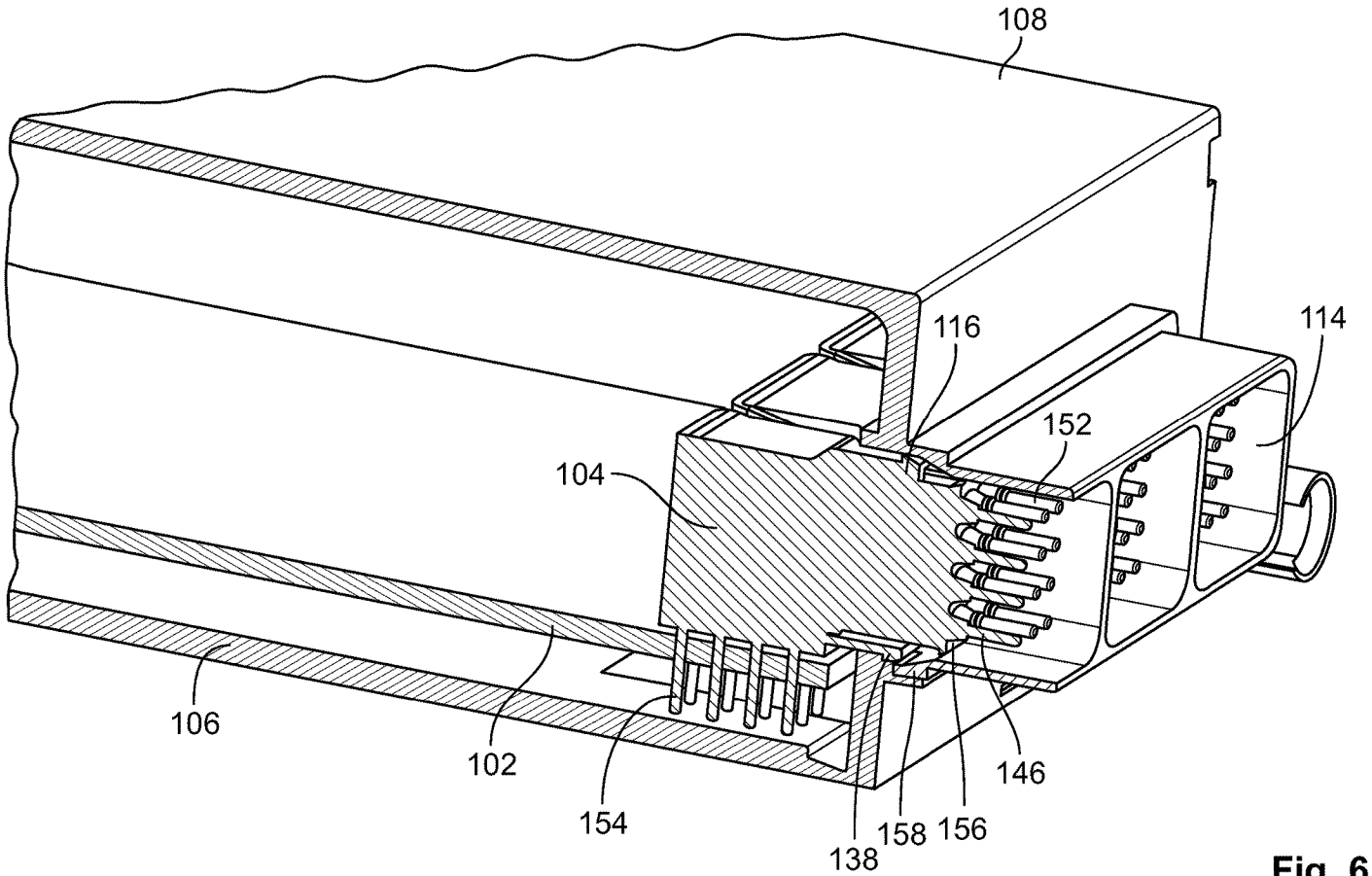
FIG. 6 is a sectional view of the electronic module.
Figure 7:
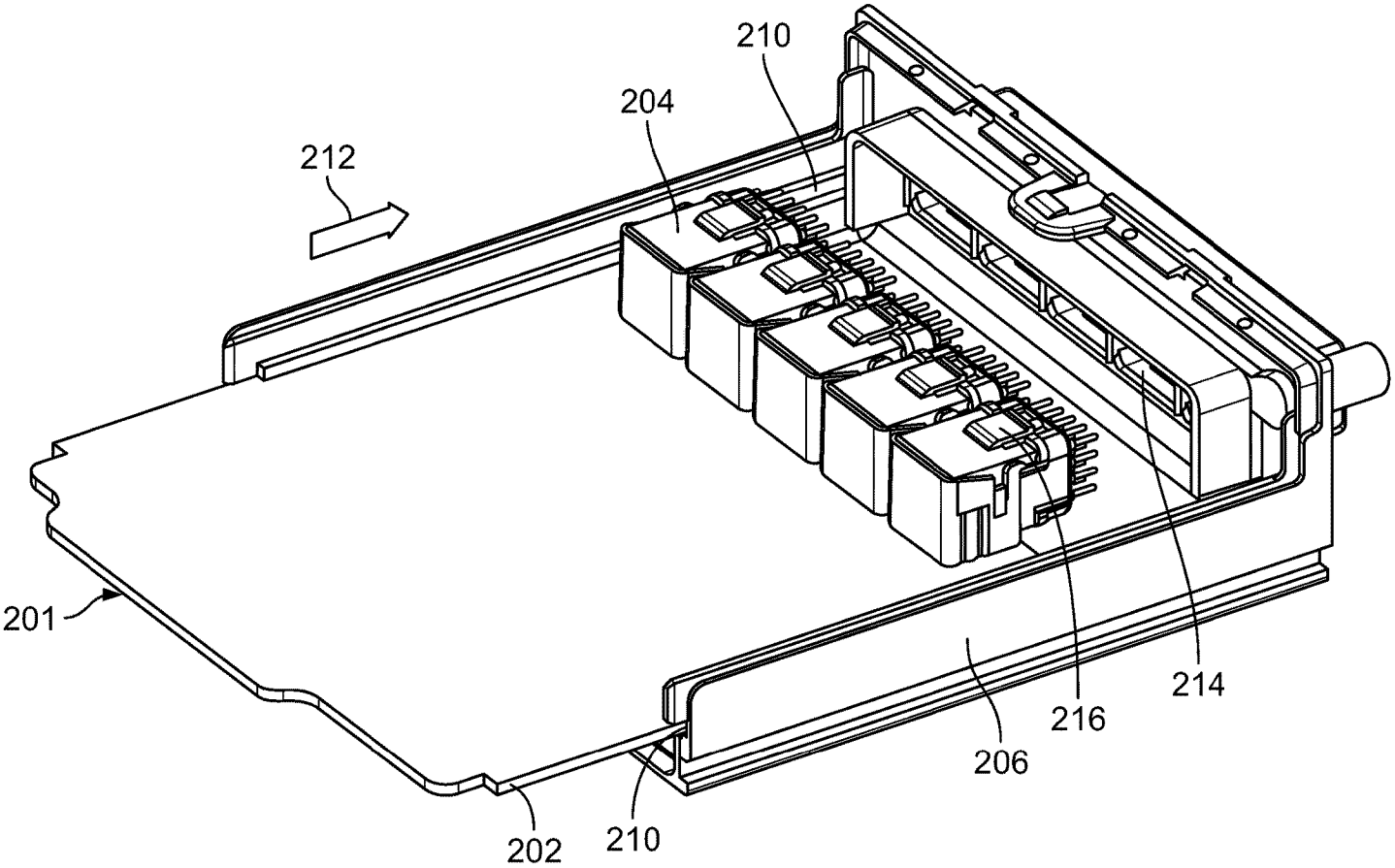
Fig. 7 PRIOR ART
FIG. 7 is a perspective view of a circuit carrier during assembly into a conventional retainer shell.
Figure 8:
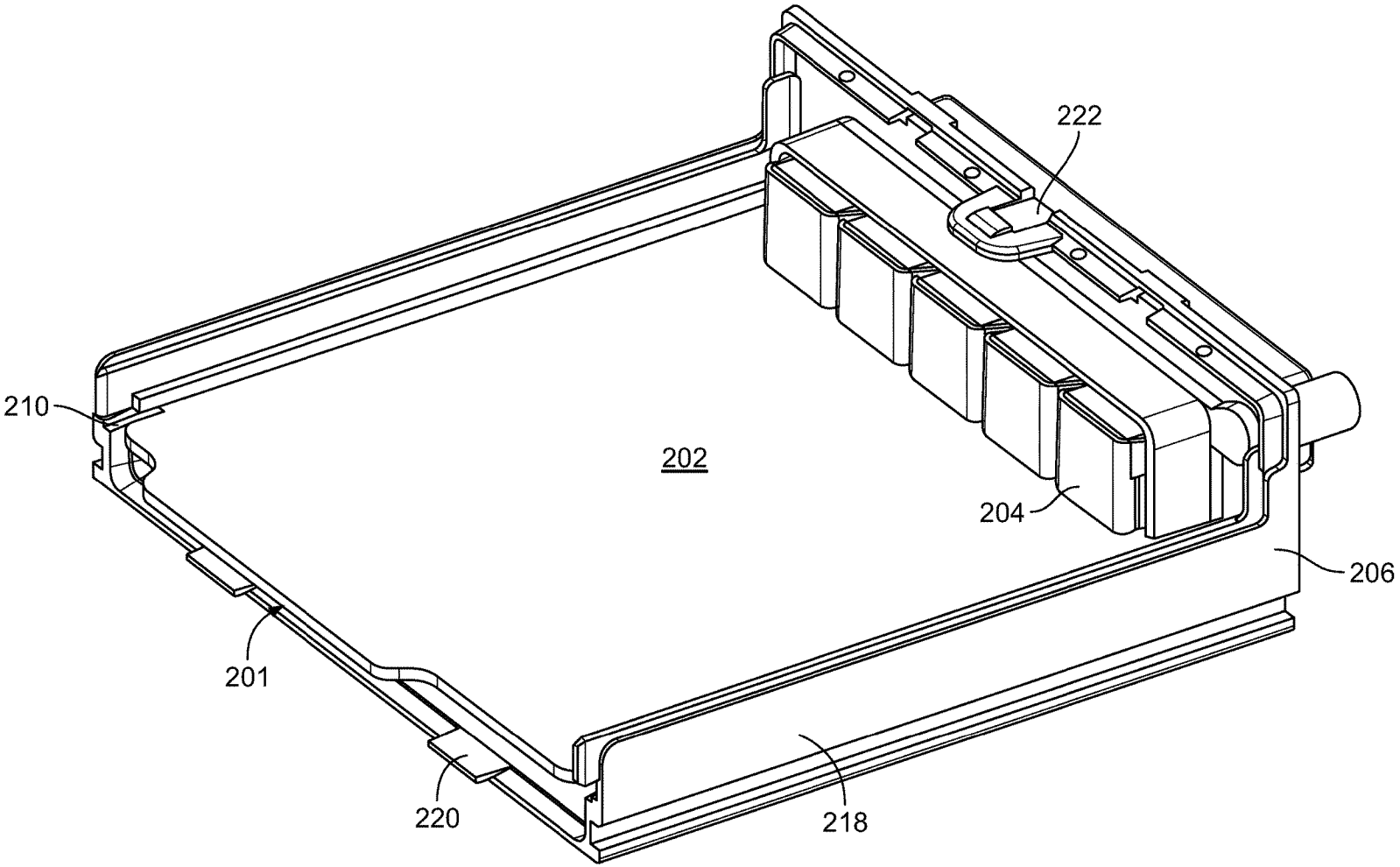
Fig. 8 PRIOR ART
FIG. 8 is a perspective view of the circuit carrier and retainer shell of FIG. 7 in a final mounted position.
Figure 9:
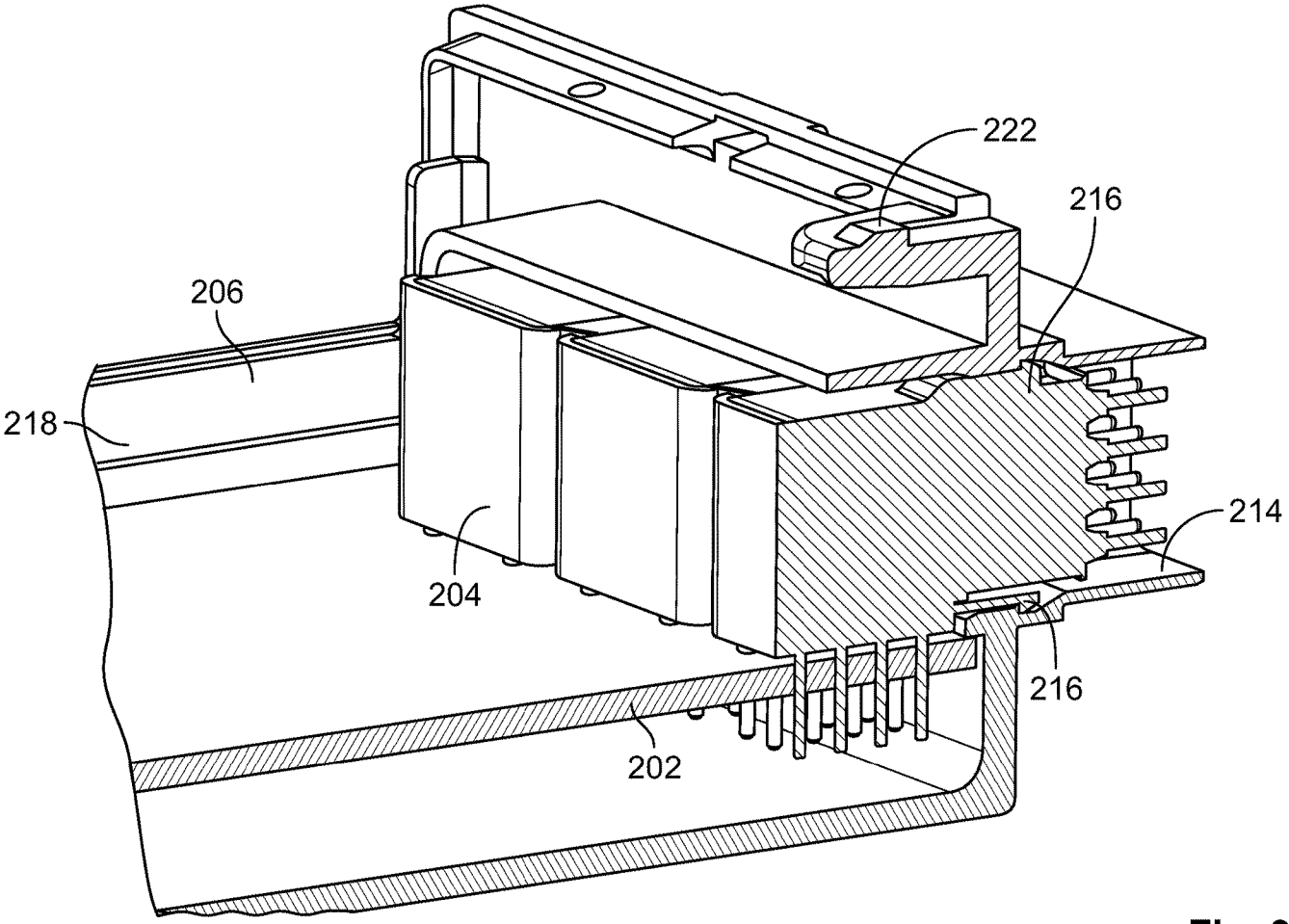
Fig. 9 PRIOR ART
FIG. 9 is a sectional view of the circuit carrier and retainer shell of FIG. 7 in the final mounted position.
Figure 10:
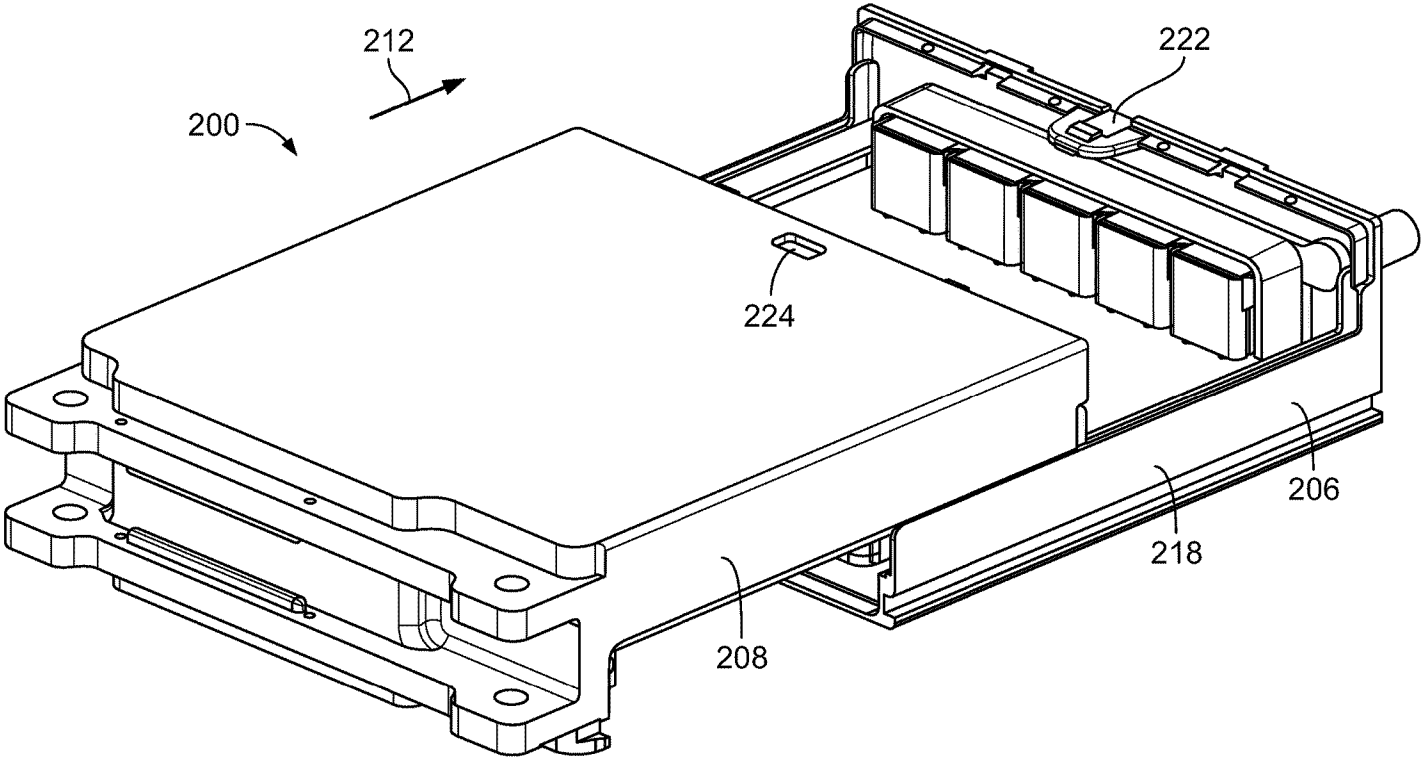
Fig. 10 PRIOR ART
FIG. 10 is a perspective view of a conventional cover shell and the retainer shell with the circuit carrier of FIG. 7 during assembly of the conventional cover shell.
Figure 11:
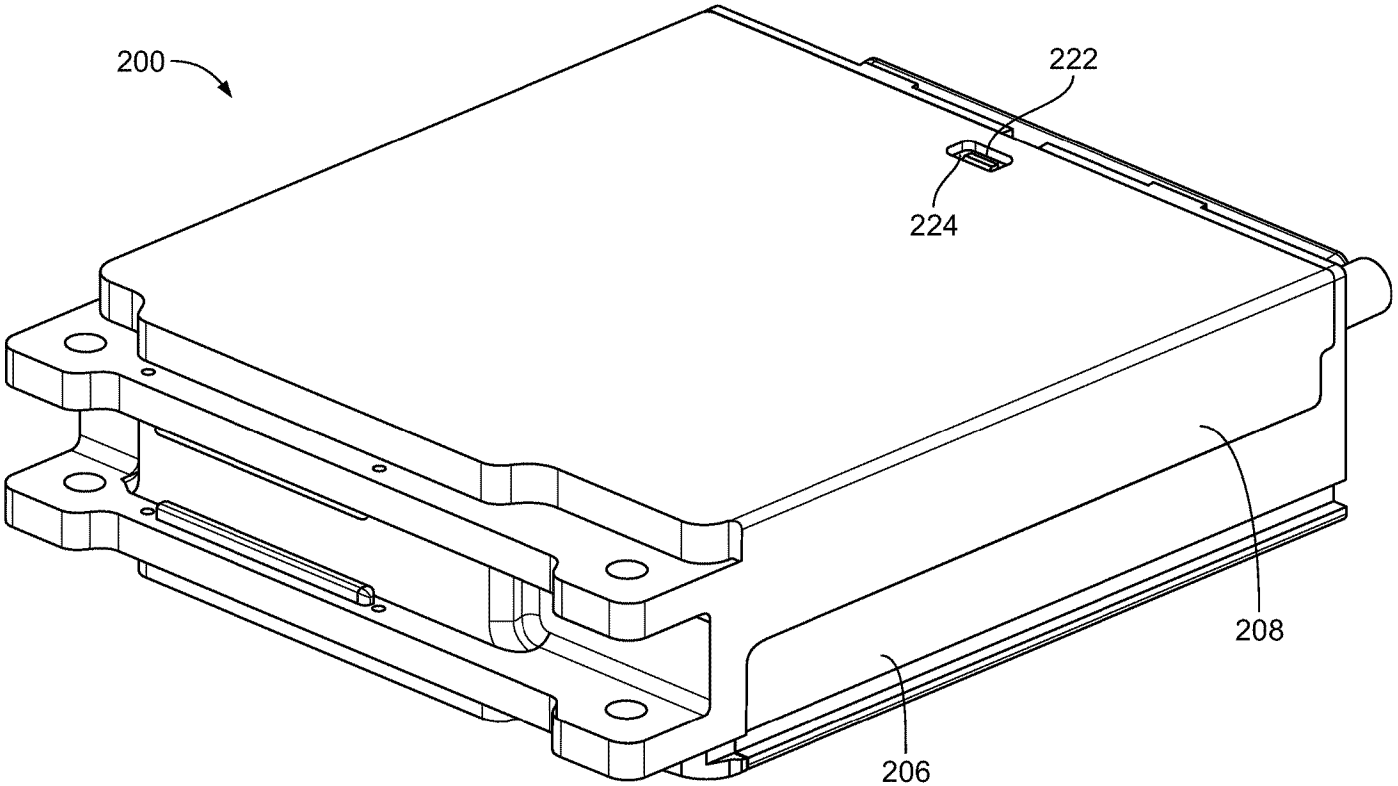
Fig. 11 PRIOR ART
FIG. 11 is a perspective view of a conventional electronic module including the circuit carrier and the retainer shell of FIG. 7 and the cover shell of FIG. 10 in a final assembled state.

An electronic module 100 including the circuit carrier 101 and the casing 105 is shown in a final assembled state in FIGS. 5 and 6. As shown in FIG. 6, the contacts 146 of each of the connector modules 104 are angled so that a contact region 152, which extends along the mating direction 107 and is connected to the mating connector, is angled by 90° with respect to a connection region 154 that is inserted into the substrate 102. By inserting the circuit carrier 101 in the mounting direction 112 transverse to the mating direction 107, it can be ensured that no undesired mechanical forces are exerted on the connection regions 154 of the contacts 146.

As shown in FIG. 6, the connector module 104, and particularly the latch 116, does not interlock with the receiving passageway 114. The connector module 104 and receiving passageway 114 are only engaged by friction and interact with one another to define the position between the mating face 156 of the connector module 104 and the receiving passageway 114. In order to achieve a secure fit, the receiving passageway 114 is supported against the retainer shell 106 in a support region 158. The connector module 104 is supported at the retainer shell 106 by its stop collar 138. Thus, no irreversible mechanical connection exists between the cover shell 108 and the connector module 104. The electronic module 100 of the can consequently be deconstructed easily and in a non-destructive manner.

What is claimed is:

1. An electrical connector, comprising:

a casing having a retaining member including a retaining projection and a retaining groove; and a connector module having an electrically insulating contact carrier, a stop collar extending at least in sections around the contact carrier and at least partially defining a retaining recess, and a plurality of electrically conductive contacts, the connector module at least partially surrounded by the casing and retained at the casing by the retaining member, the retaining projection of the retaining member engaging the retaining recess and the retaining groove of the retaining member engaging the stop collar, the retaining member exerting a retaining force on the connector module in a direction along a mating direction of the electrical connector and the connector module removable from the retaining member in a direction transverse to the mating direction.

2. The electrical connector of claim 1, wherein the casing includes a retainer shell having the retaining member and a separate cover shell at least partially covering the connector module.

3. The electrical connector of claim 2, wherein the retainer shell has a shell projection locking the cover shell to the retainer shell.

4. The electrical connector of claim 2, wherein the cover shell has a receiving passageway receiving the connector module.

5. The electrical connector of claim 4, wherein the receiving passageway guides a mating connector mating with the electrical connector.

6. The electrical connector of claim 1, wherein the retaining recess is a guiding groove receiving the retaining projection.

7. The electrical connector of claim 6, wherein the retaining projection forms a partition wall electrically insulating the contacts of the connector module from a plurality of contacts of an adjacent connector module of the electrical connector.

8. The electrical connector of claim 1, wherein the connector module is an angled connector and the contact has a contact region extending along the mating direction and a connection region extending transverse to the mating direction.

9. The electrical connector of claim 1, wherein the contact carrier and the casing are at least partially formed from PEI or a PEI composite material.

10. The electrical connector of claim 1, wherein the contact carrier includes a first housing having the stop collar and a second housing attached to the first housing.

11. The electrical connector of claim 10, wherein the retaining recess is formed between the stop collar of the first housing and an outer edge of the second housing.

12. The electrical connector of claim 1, wherein the contact carrier is a monolithically formed housing and the retaining recess is a molded indentation in the contact carrier.

13. An electronic module, comprising:

a casing having a retaining member including a retaining projection and a retaining groove; and a circuit carrier having a substrate with a connector module disposed on and connected to the substrate, the connector module having an electrically insulating contact carrier, a stop collar extending at least in sections around the contact carrier and at least partially defining a retaining recess, and a plurality of electrically conductive contacts, the circuit carrier at least partially surrounded by the casing and retained at the casing by the retaining member, the retaining projection of the retaining member engaging the retaining recess and the retaining groove of the retaining member engaging the stop collar, the circuit carrier removable from the retaining member in a direction transverse to a mating direction of the connector module.

14. A method for assembling an electronic module, comprising:

providing a retainer shell and a circuit carrier, the retainer shell having a retaining member, the circuit carrier including a substrate having a connector module disposed on and connected to the substrate;

inserting the circuit carrier into the retainer shell in a direction transverse to a mating direction of the connector module, the connector module removably engaging the retaining member and held by the retaining member along the mating direction; and mounting a cover shell on the retainer shell in a direction along the mating direction, the retainer shell and the cover shell forming a casing surrounding the substrate.

15. The electronic module of claim 13, wherein the casing includes a retainer shell having the retaining member and a separate cover shell.

16. An electrical connector, comprising:

a casing including a retainer shell having a retaining member and a separate cover shell; and a connector module having an electrically insulating contact carrier and a plurality of electrically conductive contacts, the connector module at least partially surrounded by the casing and retained at the casing by the retaining member, the retaining member exerting a retaining force on the connector module in a direction along a mating direction of the electrical connector and the connector module removable from the retaining member in a direction transverse to the mating direction, the cover shell of the casing at least partially covers the connector module and has a receiving passageway receiving the connector module, the receiving passageway guiding a mating connector mating with the electrical connector.

17. An electrical connector, comprising:

a casing having a retaining member with a retaining projection; and a connector module having an electrically insulating contact carrier and a plurality of electrically conductive contacts, the connector module at least partially surrounded by the casing and retained at the casing by the retaining member, the retaining member exerting a retaining force on the connector module in a direction along a mating direction of the electrical connector and the connector module removable from the retaining member in a direction transverse to the mating direction, the retaining projection of the retaining member engages a retaining recess of the connector module that is a guiding groove receiving the retaining projection, the retaining projection forms a partition wall electrically insulating the contacts of the connector module from a plurality of contacts of an adjacent connector module of the electrical connector.

* * * * *